US005105161A

United States Patent [19]

Takami et al.

[11] Patent Number: 5,105,161

[45] Date of Patent: Apr. 14, 1992

[54] STRONG-CONVERGENT TYPE CHARGED PARTICLE ACCELERATION/DECELERATION TUBE

[75] Inventors: Yoshio Takami, Kyoto; Shinji Nagamachi, Osaka; Masakatsu Sakisaka, Shiga, all of Japan

[73] Assignee: Shimadzu Corporation, Kyoto, Japan

[21] Appl. No.: 558,320

[22] Filed: Jul. 26, 1990

[30] Foreign Application Priority Data

Jul. 28, 1989 [JP] Japan ..... 1-197371

[51] Int. Cl.[5] ..... H05H 5/02

[52] U.S. Cl. ..... 328/233

[58] Field of Search ..... 328/233

[56] References Cited

U.S. PATENT DOCUMENTS 3,376,449 4/1968 Harrison ..... 313/361.1 X 4,596,946 6/1986 Pottier ..... 328/233 X 4,912,421 3/1990 Anderson ..... 308/233

*Primary Examiner*—Palmer C. DeMeo

[57] ABSTRACT

An acceleration/deceleration tube comprises a plurality of pairs of opposing electrodes alternatively positioned to be orthogonal along the opposing direction and overlapped by each other along the direction of the common axis, and a DC power source provided for applying specific DC voltages with a potential difference of a particular direction to each of the pairs of opposing electrodes according to the arrangement order along the common axis.

3 Claims, 2 Drawing Sheets (a)

(b)

(c)

(d)

(a)

(b)

(a)

(b)

STRONG-CONVERGENT TYPE CHARGED PARTICLE ACCELERATION/DECELERATION TUBE

BACKGROUND OF THE INVENTION

The present invention relates to a strong-convergent type charged particle acceleration/deceleration tube suitable to compose a high-current ion beam generator.

Conventionally, an acceleration/deceleration tube as shown in FIGS. 3(*a*) and 3(*b*) is used which comprises a set of electrodes of hollow cylinder or disk type. This tube is widely used for ion beam generator. FIG. 3(*a*) is a schematic construction of the ion beam generator and FIG. 3(*b*) is an explanation showing the shape of an electrode 33 (34, 35) viewed in the direction of z-axis as a common axis. In FIG. 3(*a*) an ion source 31, an extraction electrode 32, and an acceleration tube 30 are aligned coaxially along the z-axis. The acceleration tube 30 comprises three electrodes 33, 34 and 35 of hollow cylinder type. An electric power is applied to work the ion source 31 and the extraction electrode 32 from a high voltage power source (not shown). A DC voltage is applied to the electrodes 33, 34, and 35 from a high voltage power source 36 after being divided by three resistors serially connected. The voltages respectively applied to the electrodes 33, 34 and 35 are set gradually lowered, so that the electrodes 33, 34 and 35 serve to accelerate the ions. The ions generated by the ion source 31 are taken out in a beam-like form with the potential difference between the ion source 31 and the extraction electrode 32, so that they are accelerated along the z-axis by passing through the inner parts of the accelerating electrodes 33, 34 and 35.

On the other hand, in order to reduce the speed of the ions, the voltage of the high voltage power source in the ion beam generator in FIG. 3(*a*) is reversed. Then, the electrodes 33, 34 and 35 serve to reduce the speed of the ions. The ions generated by the ion source 31 are once taken out in a beam-like form but are decelerated along the z-axis by passing through the inner parts of the reduction electrodes 33, 34 and 35.

In the above-mentioned acceleration/deceleration tube, it is disadvantageous that the ion beams of high current cannot be efficiently obtained, because the electrodes 33, 34 and 35 of the hollow cylinder have weak convergent action and cannot converge the beam strongly. Further, in case where the ion beams of high current are running, it is believed that the ion beams are diverged along the x-axis or y-axis due to the Coulomb's force between the ions in the beam.

SUMMARY OF THE INVENTION

Accordingly, it is an object of the present invention to provide an improved high convergent type charged particle acceleration/deceleration tube, with high convergence during the acceleration or deceleration for producing efficiently the beam of charged particles at high current.

Briefly discribed, in accordance with the present invention, some pairs of opposing electrodes are alternatively positioned to be orthogonal along the opposing direction and, in addition, are overlapped by each other along the z-axis as their common axis.

A DC power source is provided for applying specific DC voltages to each of the pairs of opposing electrodes according to their positioning order.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 2 shows a sectional view of FIG. 1(*a*) for explaining the function.

DESCRIPTION OF THE PREFERRED EMBODIMENT

Figure 1:
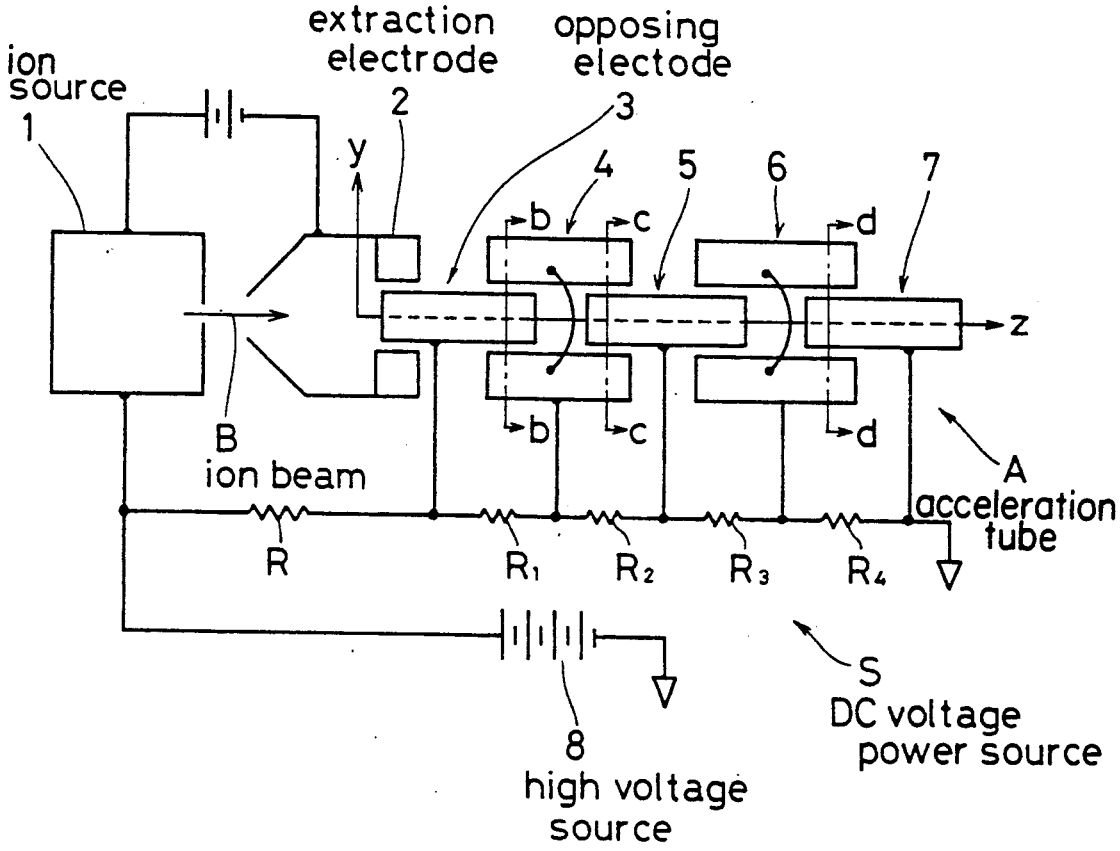
FIGS. 1 and 2 show the schematic construction of an ion beam generator operated as an acceleration tube for accelerating positive ion beams using an acceleration tube according to the present invention in which FIG. 1(*a*) shows the schematic arrangement of the respective elements, FIGS. 1(*b*) through 1(*d*) show sectional views, respectively, taken along the lines b—b, c—c, and d—d of FIG. 1(*a*).
Figure 1:
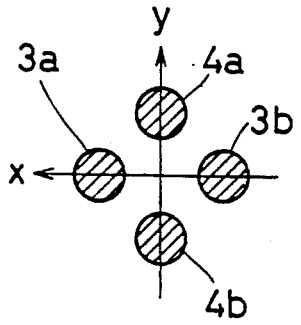
Figure 1:
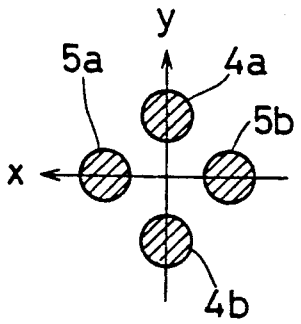
Figure 1:
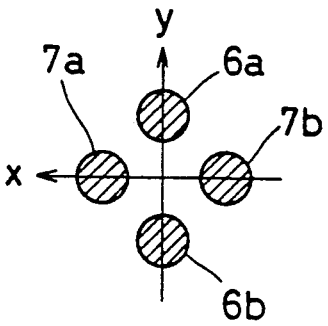

FIG. 1 shows the schematic construction of an ion beam generator operated as an acceleration tube for accelerating positive ion beams using an acceleration tube according to the present invention. More particularly, FIG. 1(*a*) shows the schematic arrangement of the respective elements and FIGS. 1(*b*) through 1(*d*) show sectional views, respectively, taken along the lines b—b, c—c, and d—d of FIG. 1(*a*).

Accordingly to the preferred embodiment of the present invention, the ion beam generator comprises an ion source 1, an extraction electrode 2 adjacently positioned at the outlet of the ion beam. An acceleration tube A is positioned at the latter stage of the extraction electrode 2. A high voltage power source (not shown) is coupled to the ion source 1 and the extraction electrode 2 in order to supply DC voltage.

The acceleration tube A comprises a plurality of, for example, 5 pairs of opposing electrodes 3, 4, 5, 6 and 7, which are arranged along the acceleration direction of the ion beam B, namely, the z-axis of the common axis. Each pair of opposing electrodes 3, 4, 5, 6 and 7 is alternatively orthogonal in the opposing direction of the electrodes.

Each pair of opposing electrodes 3, 4, 5, 6 and 7 includes a pair of electrodes 3*a* and 3*b*, 4*a* and 4*b*, 5*a* and 5*b*, 6*a* and 6*b*, and 7*a* and 7*b* of the same length, all of which respective pairs are arranged orthogorally across the z-axis. Using the orthogonal x-axis and y-axis in a plane perpendicular to the z-axis, the pairs of electrodes 3*a* and 3*b*, 5*a* and 5*b*, and 7*a* and 7*b* are arranged symmetrically along the x-axis while the pairs of electrodes 4*a* and 4*b*, and 6*a* and 6*b* are arranged symmetrically along the y-axis. At the same time, the pairs of electrodes 3 and 4, 4 and 5, 5 and 6, and, 6 and 7 are alternatively overlapped, which are adjacently positioned along the z-axis.

A DC voltage power source S is coupled to the thus-arranged pairs of electrodes 3, 4, 5, 6, and 7 to supply them with specific DC voltages with potential differences of a particular direction according to the arrangement order. The DC voltage power source S comprises a high voltage source 8 and a potentiometer circuit for dividing the DC voltage, from the high voltage source 8, with resistors $R_1$ to $R_4$ and applying the divided voltages to the pairs of opposing electrodes 3, 4, 5, 6 and 7. The DC voltages applied to the pairs of opposing electrodes 3, 4, 5, 6 and 7 are set progressively lower from the pair of opposing electrodes 3 positioned at the extraction electrode 2 through the pair of opposing electrodes 7 at the last stage, thus serving as acceleration electrodes. At this time, the two electrodes of each pair of opposing electrodes, 3*a* and 3*b*, 4*a* and 4*b*, 5*a* and 5*b*, 6*a* and 6*b*, and 7*a* and 7*b* are electrically connected to each other to be at the same potential.

Now, when the acceleration tube of the present invention is used the function and operation of the ion beam generator will be described hereinbelow.

The positive ions generated in the ion source 1 are taken out with the potential difference between the ion source 1 and the extraction electrode 2 in order to form an ion beam B. The ion beam B is introduced into the acceleration tube A to pass through the inner portions of the pairs of opposing electrodes 3, 4, 5, 6 and 7 serving as the acceleration electrodes, so that the beam is accelerated gradually along the z-axis.

Figure 2:
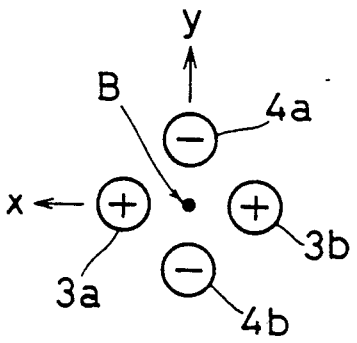
Figure 2:
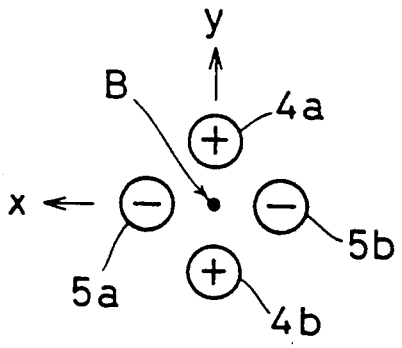
Figure 3:
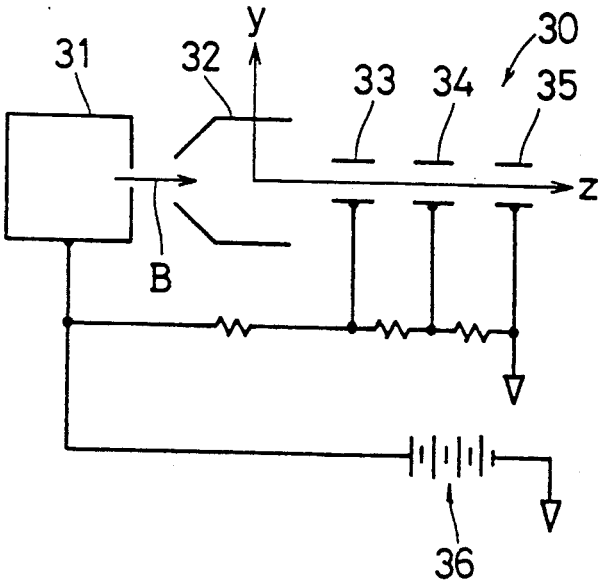
FIG. 3 shows the schematic structure of the conventional ion beam generator composed with a conventional acceleration tube in which FIG. 3(*a*) shows the schematic arrangement of the respective element and FIG. 3(*b*) shows an explanation drawing viewed from the z-axis as the common axis.
Figure 3:
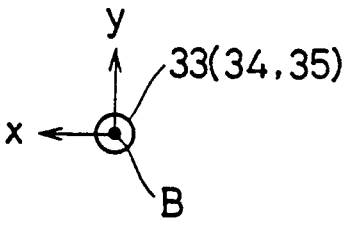

When the positive ions reach the overlapping portion of the pairs of opposing electrodes 3 and 4, the potential of the positive ions becomes intermediate between the potential of the pair of opposing electrodes 3 and that of the pair of opposing electrodes 4. At the overlapping portion of the pairs of opposing electrodes 3 and 4, as shown in FIG. 2(*a*), the potential in the plane of the x-axis and the y-axis from the potential of the positive ion beam B is such that the pair of opposing electrodes 3*a* and 3*b* are positive and the pair of opposing electrodes 4*a* and 4*b* are negative. Thus, a quadrupole polarization electrode is formed. Therefore, the ion beam B reaching the overlapping portion is extremely converged along the x-axis, whereas the beam is strongly diverged along the y-axis. By choosing the appropriate potentials applied to the electrodes 3 and 4, the convergent force is made stronger than the divergent force.

When the positive ions reach the overlapping portion of the pairs of opposing electrodes 4 and 5, the potential of the positive ions becomes intermediate between the potential of the pair of opposing electrodes 4 and that of the pair of opposing electrodes 5. Then, at the overlapping portion of the pairs of opposing electrodes 4 and 5, the potential in the plane of the x-axis and the y-axis, as shown in FIG. 2(*b*), from the potential of the positive ion beam B is such that the pair of opposing electrodes 4*a* and 4*b* are positive and the pair of opposing electrodes 5*a* and 5*b* are negative. Here, the ion beam B reaching the overlapping portion is strongly coverged along the y-axis. As the ion beam B passes through the sections b—b and c—c, it is alternatively and strongly converged (diverged) and diverged (converged) along the x(y)-axis and the y(x)-axis direction, within the acceleration tube A, but the resultant action can be made convergent. In addition, the beam is accelerated along the z-axis.

In the above description, the acceleration tube A is operated to accelerate the positive ion beams, but it should not be limited to this example. When the direction of the potential difference to be applied to the pairs of opposing electrodes 3, 4, 5, 6 and 7 in the acceleration tube A is reversed, the acceleration tube A can be operated to accelerate the negative ion beams. Further, it is needless to say that the acceleration tube A can accelerate negatively charged particles such as electron beams in the same manner.

In order to reduce the speed of the ion beams, the output voltage of the high voltage power source 8 in the ion beam generator of FIG. 1 is reversed. Then, the pairs of opposing electrodes 3, 4, 5, 6 and 7 serve to reduce the speed of the ions. The ion beam taken out from the extraction electrode 2 is decelerated in the direction of the z-axis as the beam passes through the inner portions of the pairs of opposing electrodes 3, 4, 5, 6 and 7.

As described above, the DC potentials are applied to the pairs of opposing electrodes 3, 4, 5, 6 and 7 according to the arrangement order along the z-axis, so that the charged particles are decelerated along the direction of the z-axis. At this time, the potential of the charged particles at the overlapping portion between the pairs of opposing electrodes 3, 4, 5, 6 and 7 is set to be intermediate between the potentials of the overlapping pairs of opposing electrodes. Thus, the quadrupole polarization electrodes are composed.

Then, by choosing the appropriate DC potentials applied to the electrodes 3, 4, 5, 6 and 7, the charged particles are strongly converged along the direction of the y-axis at the b—b section of FIG. 2(*b*), and along the direction of the x-axis at the c—c section of FIG. 2(*c*). Thus, while the charged particle beams are decelerated along the direction of the z-axis as a whole, they are strongly converged along the direction of the x-axis or the y-axis at the overlapping portion of the pairs of opposing electrodes 3, 4, 5, 6 and 7. Then, the charged particle beams of high current are effectively and advantageously decelerated.

While only certain embodiments of the present invention have been described, it will be apparent to those skilled in the art that various changes and modifications may be made therein without departing from the spirit and scope of the present invention as claimed.

What is claimed is:

1. A tube for accelerating or decelerating a charged particle comprising:

a plurality of pairs of opposing electrodes alternatively positioned to be orthogonal along the opposing direction, said plurality of pairs of opposing electrodes including an initiating pair, a concluding pair, and a plurality of intermediate pairs, said plurality of intermediate pairs being deposed sequentially between said initiating pair and said concluding pair, each pair of said plurality of intermediate pairs overlapping with each immediately adjacent pair of said plurality of pairs of opposing electrodes along the direction of their common axis; and DC power source means provided for applying specific DC potentials to each of said pairs of opposing electrodes according to the arrangement order along the common axis.

2. The tube as set forth in claim 1, wherein a quadruple polarization electrode structure is composed at each overlapping portion of said pairs of opposing electrodes.

3. The tube as set forth in claim 1, wherein the number of said plurality of pairs of opposing electrodes is five.

* * * * *